US009659492B2

(12) United States Patent
Modica et al.

(10) Patent No.: US 9,659,492 B2
(45) Date of Patent: May 23, 2017

(54) REAL-TIME VEHICLE SPACING CONTROL

(71) Applicant: Navteq B.V., Veldhoven (NL)

(72) Inventors: Leo Modica, Wheaton, IL (US); Leon Stenneth, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 179 days.

(21) Appl. No.: 13/739,709

(22) Filed: Jan. 11, 2013

(65) Prior Publication Data

US 2014/0197967 A1 Jul. 17, 2014

(51) Int. Cl.

| | |
|---|---|
| ***G08G 1/00*** | (2006.01) |
| ***G08G 1/09*** | (2006.01) |
| ***G08G 1/01*** | (2006.01) |
| ***G08G 1/0967*** | (2006.01) |
| ***G08G 1/0968*** | (2006.01) |

(52) U.S. Cl.

CPC ..... *G08G 1/09* (2013.01); *G08G 1/0112* (2013.01); *G08G 1/0133* (2013.01); *G08G 1/0141* (2013.01); *G08G 1/096775* (2013.01); *G08G 1/096844* (2013.01)

(58) Field of Classification Search

None

See application file for complete search history.

(56) References Cited

U.S. PATENT DOCUMENTS

| | | | | |
|---|---|---|---|---|
| 4,092,718 | A | 5/1978 | Wendt | |
| 4,791,571 | A | 12/1988 | Takahashi et al. | |
| 5,068,654 | A | 11/1991 | Husher | |
| 5,541,845 | A | 7/1996 | Klein | |
| 6,137,425 | A * | 10/2000 | Oster et al. | 340/994 |
| 6,374,176 | B1 | 4/2002 | Schmier et al. | |
| 6,405,132 | B1 * | 6/2002 | Breed et al. | 701/301 |
| 6,487,496 | B2 * | 11/2002 | Katayama et al. | 701/417 |
| 6,681,174 | B1 * | 1/2004 | Harvey et al. | 701/117 |
| 6,694,248 | B2 | 2/2004 | Smith et al. | |
| 6,958,709 | B2 * | 10/2005 | Izbicki et al. | 340/994 |

(Continued)

FOREIGN PATENT DOCUMENTS

| | | |
|---|---|---|
| EP | 1403163 | 3/2004 |
| EP | 1681663 | 7/2006 |

OTHER PUBLICATIONS

Keith W. Cunningham, "Modeling Bus Routes and Bus Stops", Spatial Data Research, Inc, 2003.

(Continued)

*Primary Examiner* — Julie Lieu

(74) *Attorney, Agent, or Firm* — Lempia Summerfield Katz LLC

(57) ABSTRACT

In an embodiment, a system detects when vehicle bunching is about to occur or is already occurring within a given transit system. The system resolves the bunching using an event and tone based system which regulates the arrival and departure times of vehicles at vehicle stops. Also, an embodiment includes a method for receiving location information for a plurality of vehicles along a route, determining a relative distance between a first vehicle of the plurality of vehicles and at least a second vehicle of the plurality of vehicles as a function of the received location information, and generating an action signal for at least one of the plurality of vehicles located on the route, wherein the action signal is in response to the determined relative distance.

19 Claims, 9 Drawing Sheets

(56) References Cited

U.S. PATENT DOCUMENTS

| | | | | |
|---|---|---|---|---|
| 7,469,827 | B2 | 12/2008 | Katragadda et al. | |
| 7,602,311 | B2 * | 10/2009 | Price | 340/903 |
| 8,352,111 | B2 * | 1/2013 | Mudalige | 701/24 |
| 2004/0138805 | A1 | 7/2004 | Feray | |
| 2006/0074545 | A1 * | 4/2006 | Kim | 701/117 |
| 2006/0161341 | A1 | 7/2006 | Haegebarth et al. | |
| 2007/0203634 | A1 * | 8/2007 | Dort | G08G 1/0104 701/70 |
| 2010/0256852 | A1 * | 10/2010 | Mudalige | 701/24 |
| 2012/0290185 | A1 * | 11/2012 | Cooper et al. | 701/93 |
| 2013/0041941 | A1 * | 2/2013 | Tomasic et al. | 709/203 |
| 2014/0085106 | A1 * | 3/2014 | Clifford et al. | 340/903 |
| 2014/0247159 | A1 * | 9/2014 | Cross | G08G 1/082 340/906 |
| 2015/0046073 | A1 * | 2/2015 | Saloner | G08G 1/096716 701/117 |

OTHER PUBLICATIONS

International Search Report and Written Opinion cited in PCT/EP2013/076030, mailed May 8, 2014.

* cited by examiner

REAL-TIME VEHICLE SPACING CONTROL

FIELD

The following disclosure relates to vehicle transportation systems and transit related applications, and more specifically to predicting, detecting, or resolving transit systems vehicle separation and spacing issues.

BACKGROUND

In transport systems bus bunching, clumping, or platooning refers to a group of two or more transit vehicles along the same route, such as buses or trains, which are scheduled to be evenly spaced according to distance and/or time, but are running near the same location at the same time. This occurs when at least one of the vehicles is unable to keep to a planned schedule and therefore ends up in the same location as one or more other vehicles of the same route at the same time. The end result can be longer wait times for some passengers on routes that have shorter scheduled intervals.

Considering bus based transportation systems specifically, bus bunching can be caused by an inconsistent or uncharacteristic number of passengers needing to board or leave a bus at system bus stop. This may cause the bus currently at the bus stop to be delayed in the scheduled route, which in turn can cause the busses following the stopped bus to shorten the relative distance between the buses on the route. A delayed bus can also cause a larger relative distance between the stopped bus and the busses ahead of the stopped bus on the route.

When bus bunching occurs in a transit system, the system becomes inefficient for the service provider and for commuters. An accumulation of stop delays and other events on a bus route can result in bus bunching and cause prospective bus passengers to have extended wait times, or overcrowded buses. For example, if three buses are travelling exactly behind each other on the same route and direction, the two latter buses may be merely wasting fuel, while passengers just arriving at previously covered bus stops may have a long wait time. Bus bunching can cause an inefficient use of transportation system resources as some busses will be overcrowded with passengers, and others may end up underutilized and almost empty. Bus bunching can then result in the inefficient use of resources for the transit agency, for example fuel or personnel use, since one or more empty buses can be travelling at the same place and time.

SUMMARY

In an embodiment, a method is provided for receiving location information for a plurality of vehicles along a route, determining a relative distance between a first vehicle of the plurality of vehicles and at least a second vehicle of the plurality of vehicles as a function of the received location information, and generating an action signal for at least one of the plurality of vehicles located on the route, wherein the action signal is in response to the determined relative distance.

In an embodiment, the determined relative distance can correlate to a relative time between a first and a second vehicle on a route. An embodiment can also include a preferred relative distance, or relative time, between the plurality of vehicles along the route.

The action signal may be audible, visual, or otherwise presented. When the action signal is presented audibly, the action signal may comprise a tone or collection of tones indicating a desired action. These desired actions might include the actions of go, stop, wait, speed up, slow down, pass, or take out of service. The type of action signal provided after bunching detection may be determined by one or more factors such as weather, time of day, passenger count history at transit stops, distance between vehicles, distance from start and to the end of the route, service schedules, past route segments, current route segments, upcoming route segments, and future route segments. For example, a pass action signal can be used when a vehicle is full, or at capacity, and cannot accept additional passengers. The capacity of a vehicle can be determined from automatic passenger counts or from historical boarding information. In an embodiment an action signal may be repeated when it is determined that a vehicle has not performed the action correlated to a previously sent action signal.

In an embodiment, the route is comprised of stop segments and regular segments. Stop segments correspond to locations with transit stops. Vehicles on the route are determined to either be on a stop segment or a regular segment. The locations of the vehicles on the route are determined using any localization method, including Global Positioning System (GPS) localization methods.

BRIEF DESCRIPTION OF THE DRAWINGS

Exemplary embodiments of the present invention are described herein with reference to the following drawings.

DETAILED DESCRIPTION

Figure 1:
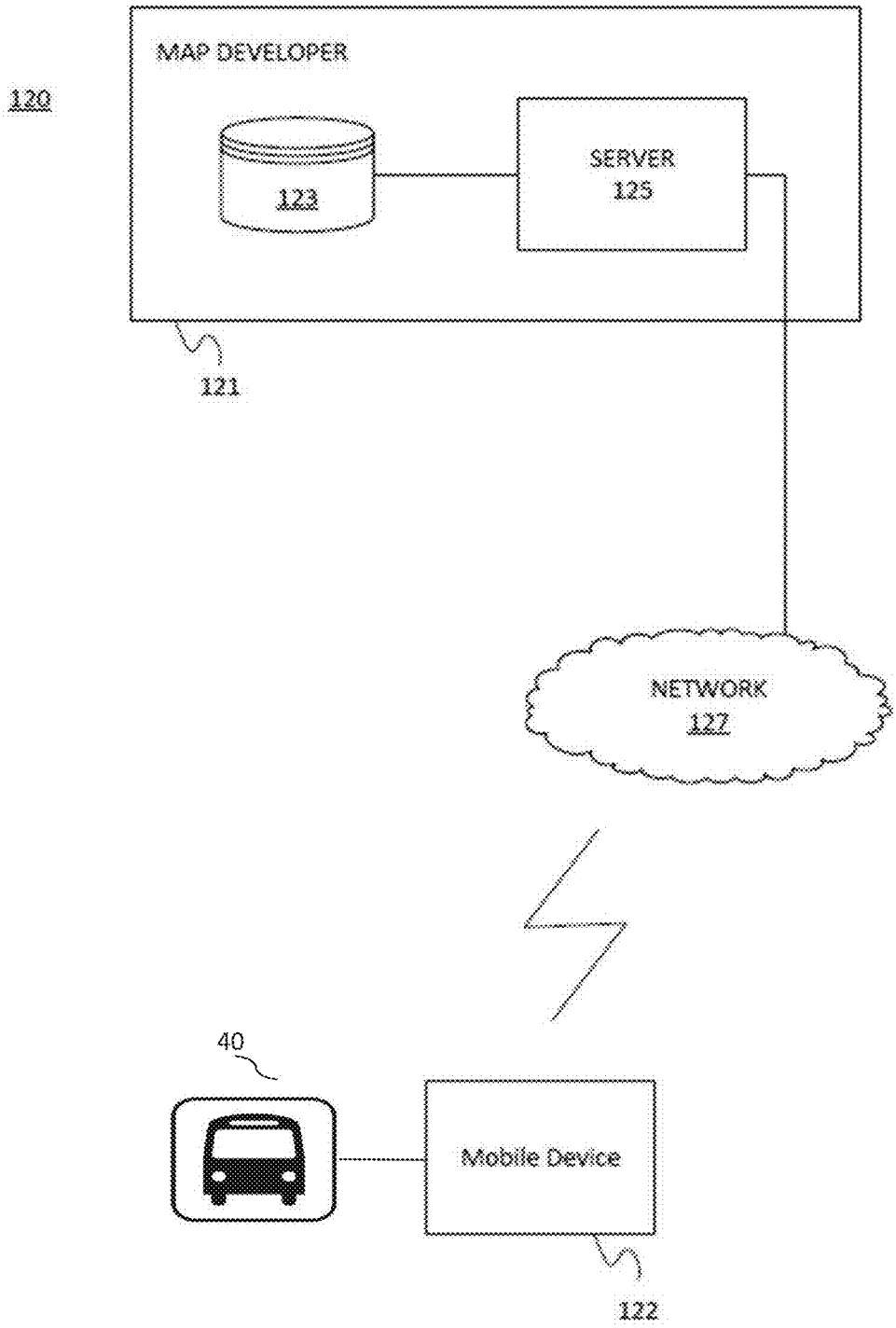
FIG. 1 illustrates an exemplary navigation system.

FIG. 1 illustrates an exemplary navigation system 120. The navigation system 120 includes a map developer system 121, a mobile device 122, and a network 127. Additional, different, or fewer components may be provided. For example, many mobile devices 122 may connect with the network 127.

The developer system 121 includes a server 125 and a database 123. The developer system 121 may include computer systems and networks of a system operator such as NAVTEQ or Nokia Corporation. The geographic database 123 may be partially or completely stored in the mobile device 122.

The developer system 121 and the mobile device 122 are coupled with the network 127. The phrase "coupled with" is defined to mean directly connected to or indirectly connected through one or more intermediate components. Such intermediate components may include hardware and/or software-based components.

The database 123 includes geographic data used for navigation-related applications. The geographic data may include data representing a road network including road segment data and node data. The road segment data represent roads, and the node data represent the ends or intersections of the roads. The road segment data and the node data indicate the location of the roads and intersections as well as various attributes of the roads and intersections. Other formats than road segments and nodes may be used for the geographic data. The geographic data may include routes and transit routes. Geographic data may be used as other transit system information to predict, detect, avoid, or resolve vehicle bunching.

The mobile device 122 includes one or more detectors or sensors as a positioning system built or embedded into or within the interior of the mobile device 122. Alternatively, the mobile device 122 uses communications signals for position determination. The mobile device 122 receives location data from the positioning system. The server 125 may receive sensor data configured to describe a position of a mobile device, or a controller of the mobile device 122 may receive the sensor data from the positioning system of the mobile device 122.

The mobile device 122 may communicate location information via the network 127 to the server 125. The server 125 may use the location information received from the mobile device 122 to associate the mobile device 122 with a vehicle 40 traveling on a route described in the geographic database 123. Server 125 may also associate the mobile device 122 with a vehicle 40 manually.

The server 125 may receive location information from multiple mobile devices 122 each associated with a vehicle 40. The server 125 may also determine a speed and direction of travel of the vehicle 40. The server 125 may use the location information provided by the mobile devices 122 with the geographic database 123 to determine a relative distance between the mobile devices 122 and the associated vehicles 40. The server 125 may then generate an action signal based on the determined relative distances. The server 125 may then communicate the action signal to the mobile device 122 via the network 127. The mobile device 122 may then relay the action signal to the associated vehicle 40.

A vehicle 40 may be any kind for vehicle. For example a vehicle may be a car, bus, airplane, train, or any other object capable of vehicular movement.

The computing resources for predicting, detecting, avoiding, or resolving vehicle bunching may be divided between the server 125 and the mobile device 122. In some embodiments, the server 125 performs a majority of the processing. In other embodiments, the mobile device 122 performs a majority of the processing. In addition, the processing is divided substantially evenly between the server 125 and the mobile device 122.

The network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

Figure 2:
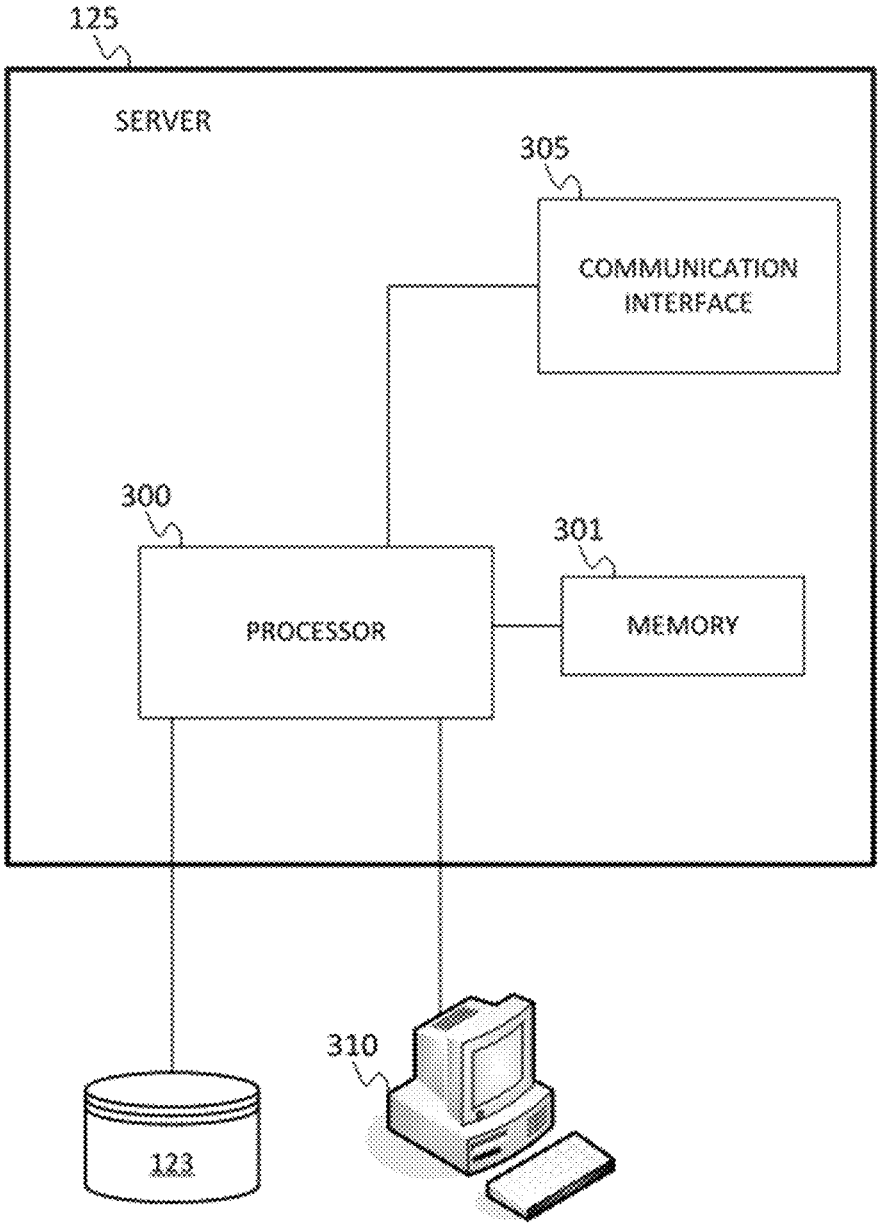
FIG. 2 illustrates an exemplary server of the vehicle bunching avoidance system of FIG. 1.

FIG. 2 illustrates an exemplary server 125 of the vehicle bunching avoidance system of FIG. 1. The server 125 includes a processor 300, a communication interface 305, and a memory 301. The server 125 may be coupled to a database 123 and a workstation 310. The database 123 may be a geographic database. The workstation 310 may be used as an input device for the server 125. In addition, the communication interface 305 is an input device for the server 125. The communication interface 305 receives data indicative of use inputs made via the mobile device 122.

The communication interface 305 is configured to receive data indicative of a plurality of mobile device positions. The memory 301 may also store data representing associations between specific mobile devices 122 and specific vehicles 40. The memory 301 is also configured to store data representing a plurality of locations that comprise a transit route. Further, the memory 301 is also configured to store data representing the current locations of a plurality of vehicles currently traveling along the transit route. The processor 300 is configured to use the data representing the current locations of a plurality of vehicles to determine a relative distance between a first vehicle of the plurality of vehicles and a second vehicle of the plurality of vehicles. The processor 300 is further configured to generate an action signal for operation of at least one of the plurality of vehicles based on the determined relative distance.

Figure 3:
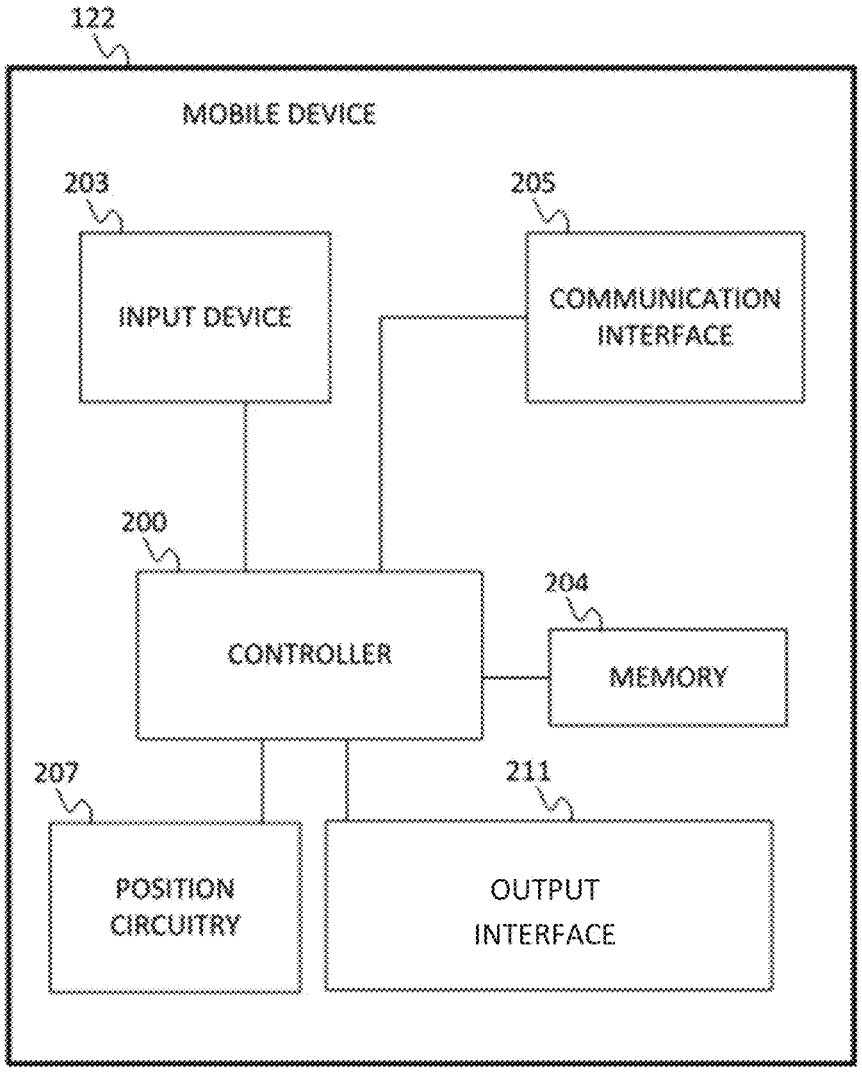
FIG. 3 illustrates an exemplary mobile device of the vehicle bunching avoidance system of FIG. 1.

FIG. 3 illustrates an exemplary mobile device 122 of the vehicle bunching avoidance system of FIG. 1. The mobile device 122 may be referred to as a navigation device. The mobile device 122 includes a controller 200, a memory 204, an input device 203, a communication interface 205, position circuitry 207, and an output interface 211. The output interface 211 may present visual or non-visual information such as audio information. Additional, different, or fewer components are possible for the mobile device 122. The mobile device 122 is a smart phone, a mobile phone, a personal digital assistant (PDA), a tablet computer, a notebook computer, a personal navigation device (PND), a portable navigation device, and/or any other known or later developed mobile device. The positioning circuitry 207, which is an example of a positioning system, is configured to determine a geographic position of the mobile device 122.

The positioning circuitry 207 may include suitable sensing devices that measure the traveling distance, speed, direction, and so on, of the mobile device 122. The positioning system may also include a receiver and correlation chip to obtain a GPS signal. Alternatively or additionally, the one or more detectors or sensors may include an accelerometer and/or a magnetic sensor built or embedded into or within the interior of the mobile device 122. The accelerometer is operable to detect, recognize, or measure the rate of change of translational and/or rotational movement of the mobile device 122. The magnetic sensor, or a compass, is configured to generate data indicative of a heading of the mobile device 122. Data from the accelerometer and the magnetic sensor may indicate orientation of the mobile device 122. The mobile device 122 receives location data from the positioning system. The location data indicates the location of the mobile device 122.

The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the mobile device 122. The positioning system may also include a receiver and correlation chip to obtain a GPS signal. The mobile device 122 receives location data from the positioning system. The location data indicates the location of the mobile device 122.

The input device 203 may be one or more buttons, keypad, keyboard, mouse, stylist pen, trackball, rocker switch, touch pad, voice recognition circuit, or other device or component for inputting data to the mobile device 122. The input device 203 and the output interface 211 may be combined as a touch screen, which may be capacitive or resistive. The output interface 211 may be a liquid crystal display (LCD) panel, light emitting diode (LED) screen, thin film transistor screen, or another type of display. The output interface 211 may also include audio capabilities, or speakers.

The controller 200 and/or processor 300 may include a general processor, digital signal processor, an application specific integrated circuit (ASIC), field programmable gate array (FPGA), analog circuit, digital circuit, combinations thereof, or other now known or later developed processor. The controller 200 and/or processor 300 may be a single device or combinations of devices, such as associated with a network, distributed processing, or cloud computing.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 301 may be removable from the mobile device 100, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

The communication interface 205 is configured to receive data indicative of a calculated relative distance between a first vehicle of a plurality of vehicles traveling along a route and at least a second vehicle of the plurality of vehicles traveling along the route. The position circuitry 207 is configured to determine the current location of the mobile device. The controller 200 is configured to generate an action signal for operation of a vehicle based on the calculated relative distance and the current location. The output interface 211 is configured to present the action signal for the operation of the first vehicle or the second vehicle.

Figure 4:
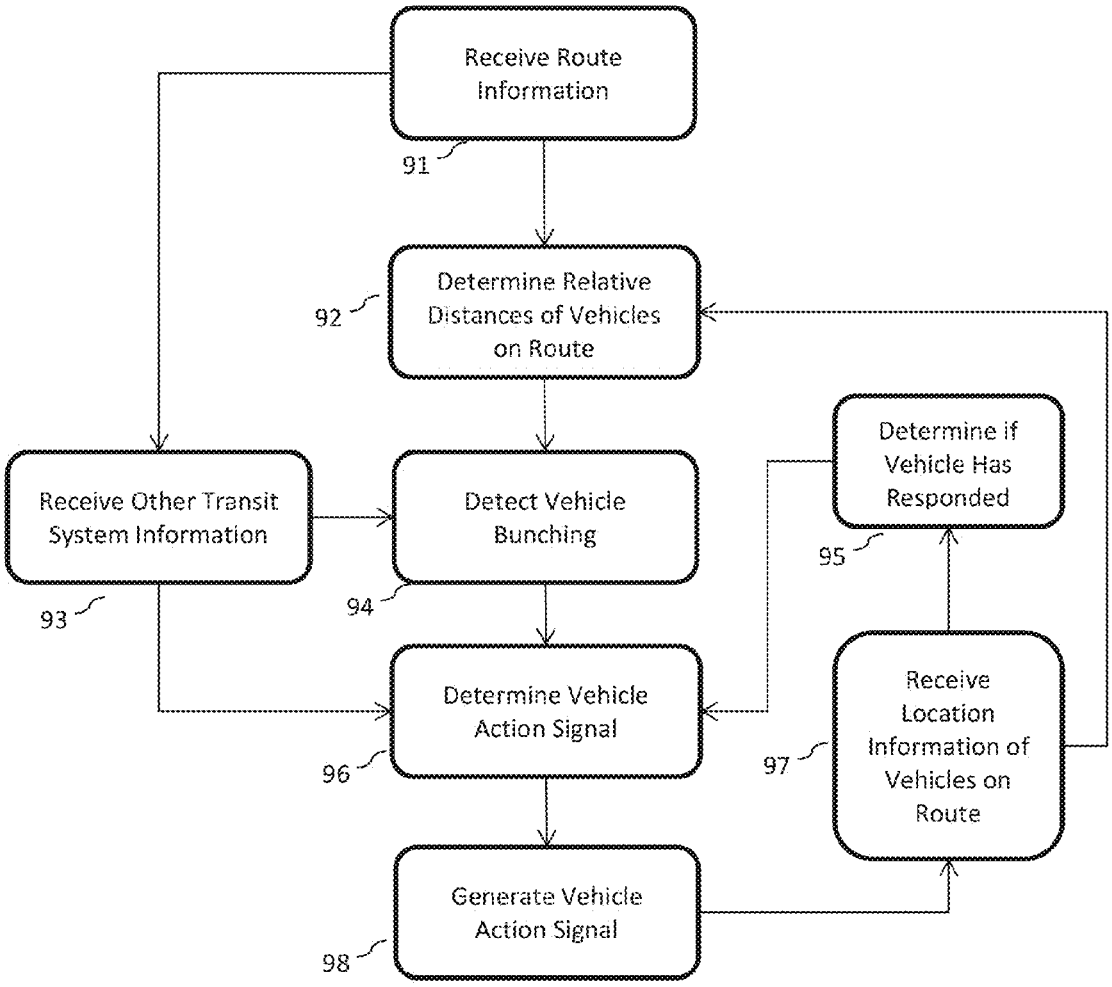
FIG. 4 illustrates an example flowchart for predicting, detecting, avoiding, and resolving transit systems vehicle bunching.

FIG. 4 illustrates an example flowchart for predicting, detecting, avoiding, and resolving vehicle spacing issues. As presented in the following sections, the term controller may refer to either controller 200 or processor 300 and the following acts may be performed by mobile device 122, server 125, or a combination thereof. Additional, different, or fewer acts may be provided. The acts are performed in the order shown or other orders. The acts may also be repeated.

At act 97 location information for vehicles on a route is received. Route information can be determined using any localization technique, including Global Positioning System (GPS) localization techniques. The location information may be received from any capable device including a mobile device as described herein, or directly from the vehicle.

At act 91 route information is received. Route information can be manually or automatically assembled into specific routes or a collection of routes. The routes may be constructed of segments, or other elements. The route information may represent actual physical roads, road segments, paths, or any other way provided for vehicle movement or travel. The routes may be transit routes such as a bus route, train route, or any other vehicle based transit route. The route information may be derived from historical data, including collected position data of vehicles. The route information may include a defined or derived schedule. The schedule may also be derived from historical data, including collected position data of vehicles. The schedule may be a transit schedule having defined stops with minimum and maximum stop times for vehicles. The schedule may include defined times at which a vehicle should be at a location.

At act 92 the location information of vehicles on the route received in act 97 along with the route information received in act 91 are used to determine relative distances of vehicles on the route. The relative distances may be measured in any system of units or may be measured in segments. The relative distances may also correlate to a relative time separating vehicles. Vehicles may be manually assigned to a route, or may be automatically assigned to a route based on the received location information received in act 97, or other transit system information.

At act 93 other transit system information is received. Other transit system information can include any information, historical or current, that may be used in predicting, avoiding, or resolving vehicle bunching. Other transit system information may include route information. Examples of other transit system information may include route schedule information, prospective passenger levels at transit stops, passenger levels on vehicles, traffic levels, traffic patterns, traffic variations at times of day, vehicle speeds, weather information, road characteristics, or community event data.

Other transit information may also include vehicle capacity measures. Vehicle capacity measures may include a total number of passengers allowed on a transit vehicle. Vehicle capacity measures may also include the total number of passengers currently traveling on a transit vehicle. Vehicle capacity measures may also include the number of projected passengers historically or currently available at transit stops. In some embodiments a driver may manually track passenger levels, and generate an at capacity signal as other transit system information. In other embodiments the at capacity signal may be automatically generated using an automated vehicle load measurement such as load cells, or a calculated passenger counting measure drawn from fare systems.

At act 94 current or prospective vehicle bunching is detected using the relative distances of vehicles on the route determined in act 91, other transit system information received in act 93, or both. An embodiment may involve using a preferred distance between vehicles on a route, or a preferred relative distance. Vehicle bunching may be detected using a determined variance from a preferred relative distance between vehicles, or a preferred relative time between vehicles. This preferred distance may be predetermined, or based on other transit system data. For example, each vehicle may be required to be within some fraction of a total distance of the route divided by the total number of operating vehicle in that direction from other vehicles. For example, if a route is has a total length of 12 kilometers (km) and there are six vehicles currently on the route then an example calculation for the preferred relative distance may include (1 route*12 km)/6 vehicles, which is a 2 km preferred relative distance. Alternatively, the preferred relative distance may be a range which varies by a percentage (e.g., 10% variance for a range of 1.9 km-2.1 km). In some embodiments, a fraction of the route may be used to define the preferred relative distance. For example, in an example in which the fraction is 4/5, the preferred relative distance may be (4/5*12 km)/6 vehicle, or 1.6 km.

In addition, one portion of the route may have a different preferred relative distance than another portion of the route. For example, if a 4 km section of the 12 km route was were to have a different preferred relative distance than the rest of the route, and there were 3 vehicles on the 4 km section then a calculation such as the following might be appropriate where (1/3 route*12 km)/3 vehicles would imply a 1.33 km preferred relative distance on the 4 km section. In this case, as vehicles are added, the distance requirement becomes smaller. A preferred relative distance may be an equal relative distance for vehicles along a route. A relative distance may be determined using any system of units. A relative distance may also be determined as a number of segments.

Also, the distance requirement may increase or decrease as vehicles are suppressed from or added to the system. A vehicle may be suppressed from a system for example because of mechanical faults. Also, a mobile device may be used to communicate to a server that a vehicle should be suppressed from a system.

A preferred distance may also correlate to a preferred time of separation of vehicles along a route. The time of separation may also take into consideration vehicle and transit system data such as number of regular segments, number of stop segments, historic vehicle speeds, current vehicle speeds, traffic levels, general segment data, or other information relating to the time of separation determination.

An embodiment may use a vehicle's distance from a route start, route end, or the current location of the vehicle or any other vehicle on a route to determine a relative distance. An embodiment may also use previous, current, or upcoming route segments for a vehicle to make the relative distance calculation. An embodiment may also use a vehicle's distance from upcoming or previous transit stops to make the relative distance calculation.

Vehicle bunching may also be anticipated or detected as an error in a route schedule by a vehicle, such as a missed stop or a delay at a stop. A route schedule may comprise a collection of route stops and other geographic locations that correlate to a predicted time a vehicle should arrive or depart from the stops or geographic locations. An embodiment may provide that a service schedule requires vehicles to stay at each stop for a minimum time. Also, an embodiment may involve vehicles leaving a stop after a maximum time.

Bunching may also be predicted or detected based on a vehicle's current passenger load, or any other transit system information.

Act 94 detecting may be de-activated at certain segments of the route or for certain vehicles on the route. For example, at the immediate start and end of route, a controller may de-activate vehicle bunching since vehicles wait to be dispatched. The vehicle bunching detection algorithm can also be de-activated at other times, such as when a vehicle is removed from a route due to a mechanical fault, or other reason.

At act 96 a vehicle action signal is determined. A vehicle action signal may be determined based on vehicle bunching detected or predicted in act 94. A vehicle action signal may also be determined based on a vehicle's response, or lack thereof, to a previous action signal. The action signal may be for any action desired to avoid or resolve vehicle bunching. Examples of desired actions may include, but are not limited to, pass, stop, go, slow-down, speed-up, skip stop, or any other desired action.

The type of action signal determined may depend on other transit system information such as weather, time of day, passenger count history at vehicle stops, distance between vehicles, a vehicle's current stop segment, distance from start and to the end of the route, service schedules, past route segments, current route segments, and future route segments of vehicles. For example, an embodiment may provide that when vehicles are at the start or end of the route they can only respond to one action signal which may be the go action signal.

A pass action signal may be determined when a vehicle is full to capacity and cannot accept additional passengers. A pass action signal may also be determined when a leading vehicle has mechanically malfunctioned. A stop action signal may work with a pass action signal. When a following vehicle is sent a pass tone, as described above, the leading vehicle may also be sent a stop action tone or a slow-down action tone. In this way tones may be used together. A go action signal can be used to dispatch vehicles from the start or end of routes. A slow down action signal may be determined when a vehicle arrives at a transit stop ahead of the vehicle's expected service schedule. This action signal may contain a temporal property that indicates the duration of the slow-down period. A speed up action signal may be used when a vehicle arrives at a vehicle stop behind the vehicle's expected service schedule. Additional action signals may be added or removed from the system.

Available action signals may be governed by transit system official policies and procedures, or physical constraints. For example, passing may not be permitted if the transit vehicle operates on tracks with no switching capabilities.

Embodiments may allow for any action signal to be used based on the transit system, location, or other transit system information so that a desired effect can be achieved. The desired effect may be a preferred relative distance, a preferred relative time, or any other desired effect.

At act 98 the vehicle action signal determined in act 96 is generated. The vehicle action signal may be issued as a communication to a mobile device, or directly to the vehicle. The vehicle action signal may take the form of any type of signal intended to instruct the vehicle to perform the desired action. The vehicle action signal may be visual audible or otherwise non-visual. The vehicle action signal could be an electronic action signal to an unmanned vehicle controller. The vehicle action signal may also take the form of single tone or a collection of tones associated with a singular or a set of actions. The tones may be specified as a set of audible and distinguishable frequencies. For example the tones may correspond to Dual-tone multi-frequency signaling tones (DTMF) used in many telephone systems. Tones may also be used together for a single vehicle to combine signals or actions to achieve the desired effect. The vehicle action signal may also take the form of a combination of pulses. These pulses may be audible, vibratory, or otherwise perceived by a vehicle operator or controller. The vehicle action signal may also be in the form of audible language. The vehicle action signal may also be visual in the form of a head-up display (HUD), or other visible device. A visual signal may be a color, text, picture, or other form of visual signal indicating a desired action. Any collection or combination of these examples, along with any other type of signal, may be used.

An action signal may also increase or decrease in presented intensity to indicate the severity of the desired action. For example, an audible action signal may be presented with increased or decreased volume depending on the relative importance or criticality of the desired action. A visual action signal may be presented larger, or more brightly depending on the relative importance or criticality of the desired action.

Each action signal may have an associated tone which is submitted to the vehicle. On receipt of these tones, the vehicle should perform the corresponding action. The tones may be sent to some device that is inside the vehicle or with the vehicle operator. Alternatively, the tones may be sent to the vehicle itself.

In act 95 a controller determines if a vehicle has performed the generated action signal. This determination may be performed using the location information received in act 97, or any other information indicating that a vehicle has or has not performed the issued action signal. The location information received in act 97 may be compared to expected location information for the vehicle based on the generated action signal. The determination may be made after a set amount of time.

Figure 5:
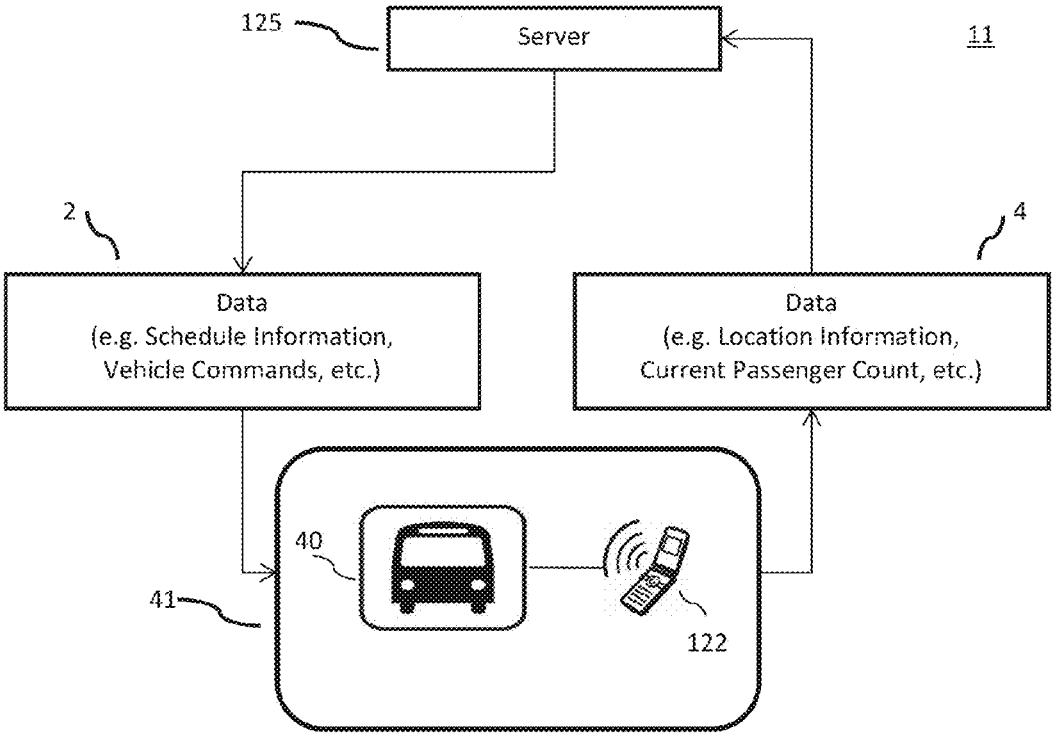
FIG. 5 illustrates an exemplary vehicle bunching avoidance system.

FIG. 5 illustrates an exemplary vehicle bunching avoidance system 11. A server 125 communicates data to a vehicle system 41. The vehicle system 41 includes a vehicle 40, and may include an association with a mobile device 122. The vehicle system 41 also communicates data 4 to the server 125.

The association with the mobile device 122 may be created through any known or yet to be discovered algorithm. The association is communicated to the server 125 so that the server 125 may identify the transit vehicle 40 location. In some embodiments the vehicle 40 may communicate position data without the use of a mobile device. In some embodiments the vehicle 40 may be considered the mobile device.

A vehicle 40 may be assigned the mobile device 122 by the server 125, or the mobile device 122 may be permanently installed on the vehicle 40, or the mobile device 122 may be removable or interchangeable. Also, an operator of vehicle 40 may initiate or create the association by entering identity information into the mobile device 122. For example, the user may enter data including the identification of vehicle 40 into mobile device 122 in order to create the association. Alternatively, the server 125 may store a lookup table of associations in memory 301. The lookup table associated pairwise combinations of mobile devices and vehicles.

The server 125 may also maintain associations of groups of mobile devices. For example, each mobile device 122 associate with a vehicle on the same route is associated with the group of mobile devices for the route. In an embodiment, a route may be assigned a route identifier (ID) by the server 125. Location data may be shared among mobile device 122 in a group of vehicles sharing a current assigned route ID, and the server 125 analyzes the relative locations of vehicles in the group with respect to other vehicles in the same group.

Figure 6:
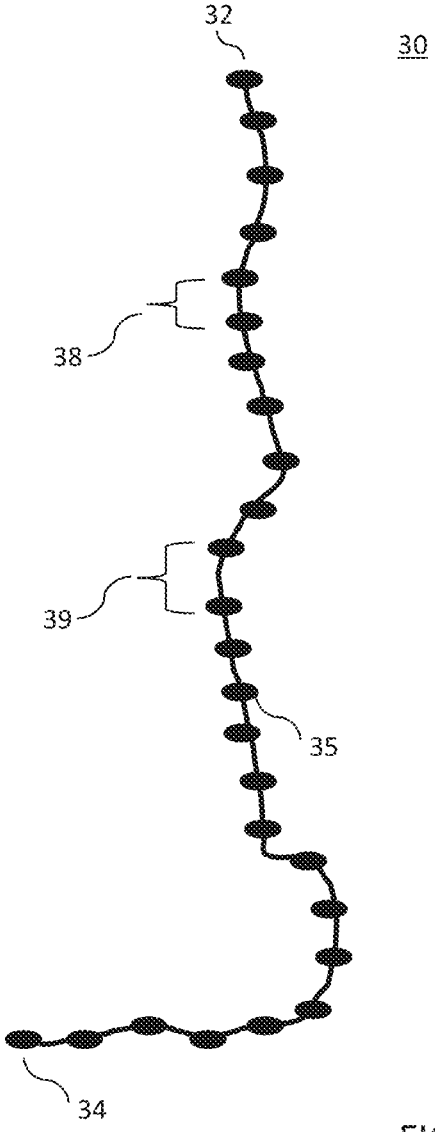
FIG. 6 illustrates an example transit route.

FIG. 6 illustrates an example of a transit route 30. The transit route 30 includes nodes 35 and segments 38 and 39. Transit route segments 38 and 39 may be the same length, or different lengths. The segments may be determined manually or automatically. Transit route 30 comprises stop segments 38, regular segments 39, as well as a route start 32, and a route end 34. Stop segments 38 are segments that include transit stops. Regular segments are portions of the transit route 30 that do not include a transit stop. A stop segment 38 may change to a regular segment 39 when a transit stop is removed. Also, a regular segment 39 may change to a stop segment 38 when a transit stop is added. The nodes 35 may be defined as a cluster of points. The nodes 35 may be at predetermined locations such as transit stops. The nodes 35 may be calculated based on location data collected by the mobile device 122 or multiple mobile devices.

The server 125 may be configured to compare the location data to identify sets of data points. The sets of data points may be within a threshold distance from one another. In one example, the server 125 selects a location data point and counts the number of location data points within the threshold distance from the first selected data point. If the number of location data points exceeds a minimum number (e.g., 2, 5, 10), the set of data points are identified by the server 125 as a cluster. The cluster may be stored as a geographic range including the set of data points or the cluster may be stored as the average of the set of data points. The distance between clusters may be arbitrary as a result of dependence on the clustering of the data points. Alternatively, the server 125 may target a specific distance between clusters.

The route 30 may be comprised of legs wherein a leg is a route in a single direction. An embodiment may be implemented on a particular leg of a route, or across an entire route. An embodiment may also be implemented on a singular segment of a route, or any collection of segments or sections of a route.

Figure 7:
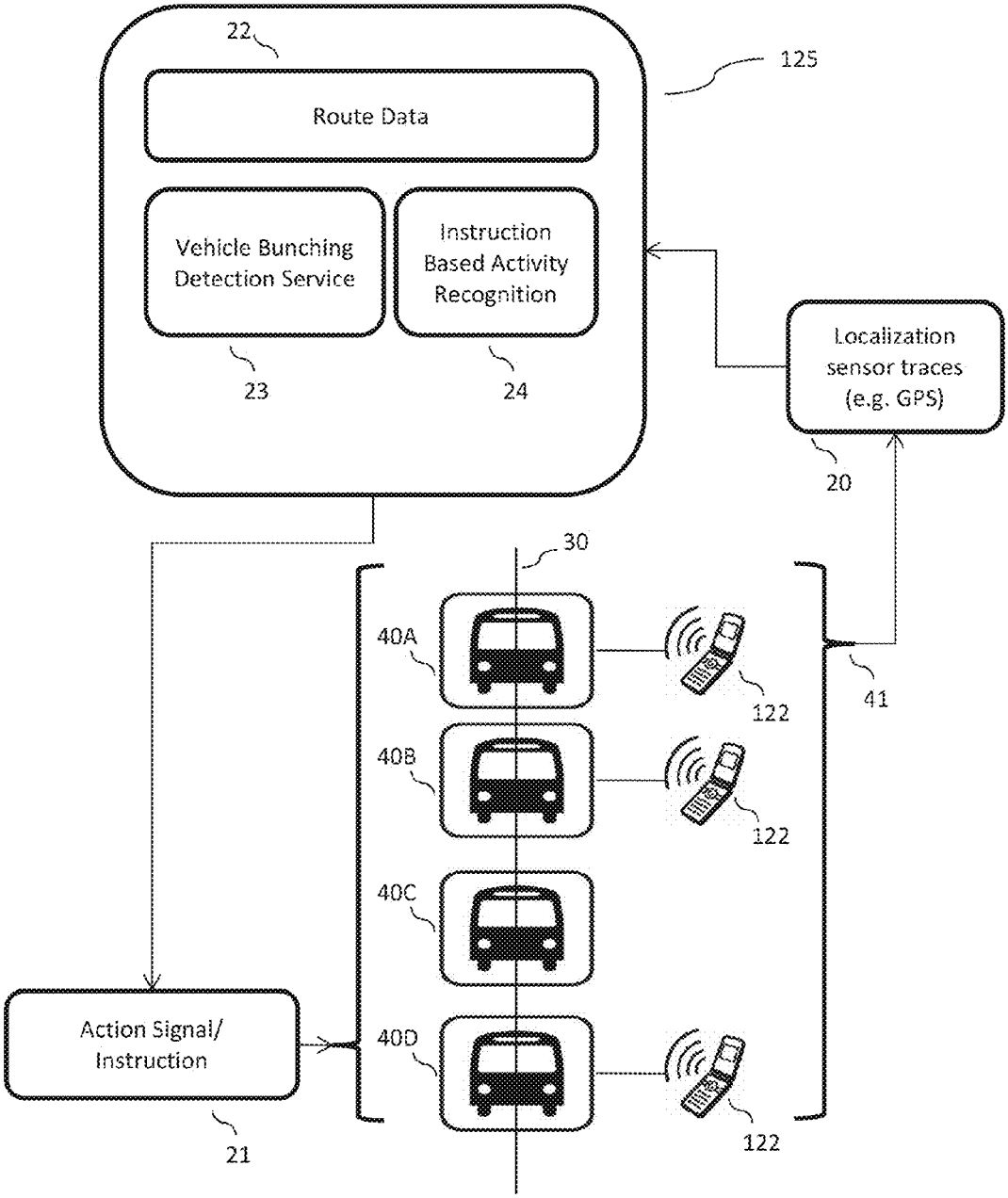
FIG. 7 illustrates another example of a vehicle bunching avoidance system.

FIG. 7 illustrates another example of a vehicle bunching avoidance system. The server 125 contains route data 22 for a transit system that includes at least data representing route 30. The server 125 receives location information 20 from a plurality of vehicles 41 on a route 30. The server 125 determines a relative distance between a first vehicle 40C of the plurality of vehicles 41 and at least a second vehicle 40A-D of the plurality of vehicles 41 as a function of the received location information 20. The server 125 may implement a vehicle bunching detection service 23. The server 125 is operable to generate an action signal or instruction 21 and communicate the action signal or instruction 21 to any of the plurality of vehicles 41.

The plurality of vehicles 41 may have an association with a mobile device 122. The mobile device 122 may be in communication with the server 125, or a vehicle 40C may be considered a mobile device 122.

The server 125 may also be operable to use the location information 20 to recognize whether a vehicle 40 has performed the generated action signal 21. Recognizing whether a vehicle 40 has performed the generated action signal may involve comparing collected location information 20 to expected location information. Recognizing whether a vehicle 40 has performed the generated action signal 21 may also involve waiting a set period of time to determine if the collected location information 20 correlates to expected location information. When a server 125 recognizes that an action signal or instruction 21 has not been performed, the server 125 may resend the action signal or instruction 21 to vehicle 40. The server 125 may also resend the action signal 21 with further instructions to present the action signal 21 in an intensified manner. For example the server 125 may instruct that the action signal 21 be presented louder than the previous action signal 21.

Figure 8:
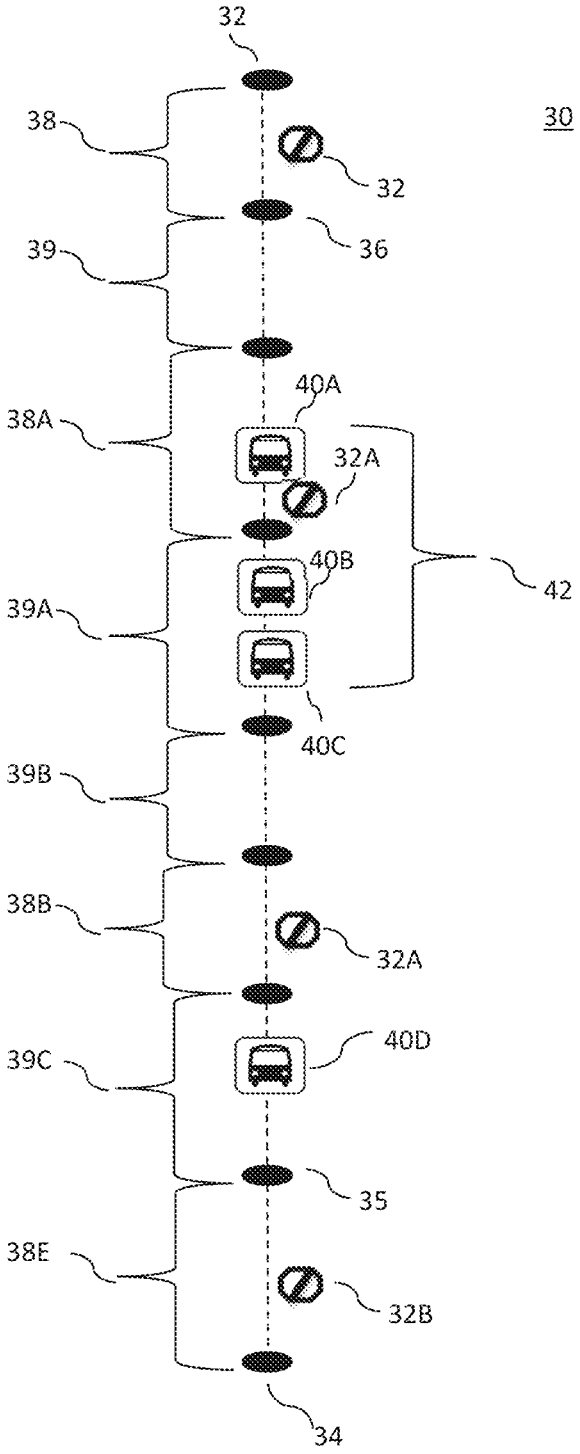
FIG. 8 illustrates an example of vehicles on the transit route of FIG. 5.

FIG. 8 illustrates an example of a vehicles 40A-D on a route 30. The route 30 is comprised of stop segments 38 and regular segments 39. A stop segment 38 has a stop 32 included in the segment. A regular segment 39 is any other segment connecting nodes 35. The stop 32 may be a planned schedule stop, or any other kind of stop for a vehicle.

A vehicle bunch 42 is shown. In this example a vehicle 40C is shown as the vehicle bunch instigator. The vehicle bunch may have been caused when a vehicle 40C stayed longer than scheduled at stop 32A. This would cause following vehicles 40A-B to approach the bunch instigator vehicle 40C leaving a shorter relative distance and time between vehicles 40C-A. The bunch instigator vehicle's 40C actions may also cause the distance and time between the vehicle bunch 42 and a leading vehicle 40D, as shown by the multiple segments 39B and 38B between the bunch instigator 40C and the leading vehicle 40D.

A vehicle bunch 42 may be resolved or avoided by actions taken by any of the vehicles 40A-D on the route 30. A vehicle 40A may wait longer at a stop 32A while other vehicles 40B and 40C continue traveling on the route 30. A vehicle 40D may also slow down. A vehicle 40B may also pass another vehicle 40C. A vehicle 40C may also speed up. A vehicle 40C may also skip an upcoming stop 32A. Any of these actions could also be combined to resolve or avoid the vehicle bunch 42. These actions may also be communicated to the vehicles 40A-D as desired actions, or requested actions to resolve or avoid the vehicle bunch 42.

Figure 9:
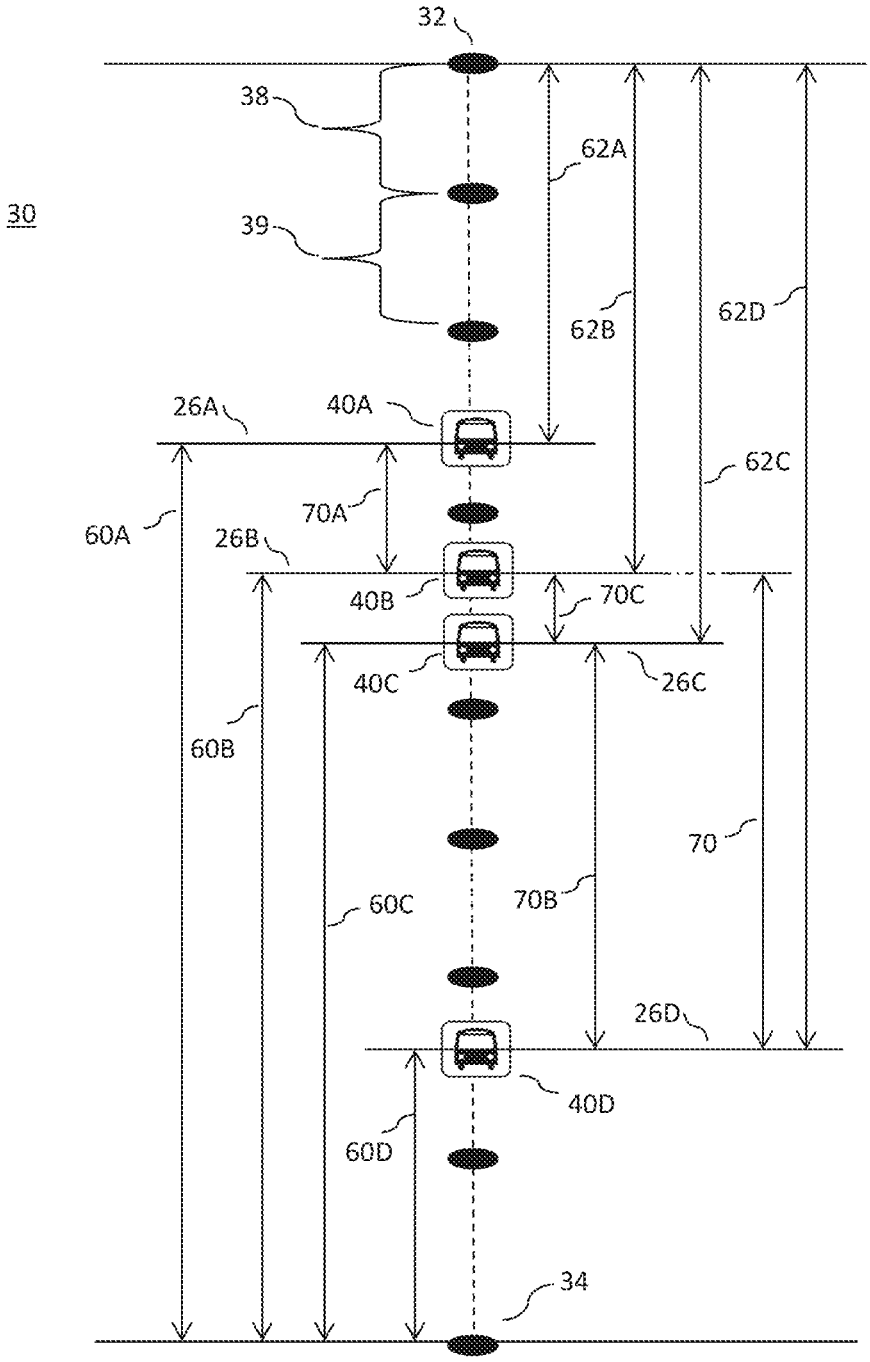
FIG. 9 illustrates another example of vehicles on the transit route of FIG. 5.

FIG. 9 illustrates another example of vehicles 40A-D on a route 30 comprised of stop segments 38 and regular segments 39. The positions 26A-D of vehicles 40A-D along the route 30 stored in a memory 301 or 204. From this information, distances 62A-D from the route start 32 and the distances 60A-D from the route end 34 can be determined for the vehicles 40A-D. Further, a relative distance 70 can be determined between vehicles 40B 40D. The distances 62A-D from the route start 32 and the distances 60A-D from the route end 34 can The distances 62A-D from the route start 32 and the distances 60A-D from the route end 34 can be an actual distance measured in any units relative to the start or end of the route. As an example inches, feet, yards, or meters may be used. The distances 62A-D from the route start 32 and the distances 60A-D from the route end 34 can also be measured in number of segments.

The relative distance 70 can be an actual distance measured in any units. As an example inches, feet, yards, or meters may be used. The relative distance 70 can also be measured in number of segments. The relative distance 70 may change as the vehicles 40B 40D travel along the route 30. A relative distance 70 70A 70B 70C may be determined between any of the vehicles 40A-D on the route 30.

The relative distance may also correlate to a relative time separating vehicles 40B 40D. The relative time may be determined using any data that would allow the determination of a time required to travel the relative distance 70 by a vehicle 40B. For example the number of stop segments 38 and regular segments 39 on the route separating the vehicles 40B and 40D, where a stop segment 38 may take a longer time to travel than a regular segment 39. The length of segments may also be taken into account. Also, traffic data, historical and current route characteristics, or vehicle characteristics may be taken into account. Current vehicle conditions, speeds or directions of travel may also be taken into account. A relative time may be determined between any of the vehicles 40A-D on the route 30.

While the non-transitory computer-readable medium is described to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method comprising:

receiving current location information for a plurality of vehicles assigned to a route, wherein the location information comprises locations of the plurality of vehicles determined by mobile devices located with the vehicles, and the route comprises a plurality of sequential stop locations serviced by individual vehicles of the plurality of vehicles at different times;

receiving traffic conditions for the route;

determining a number of projected passengers for at least one of the plurality of sequential stop locations;

identifying a vehicle capacity value for at least one of the plurality of vehicles;

determining, with a controller, a relative distance between a first vehicle of the plurality of vehicles and at least a second vehicle of the plurality of vehicles as a function of the received current location information;

determining, with the controller, a relative time between the first and second vehicles based on the relative distance and traffic conditions; and generating an action signal for at least one of the plurality of vehicles located on the route, wherein the action signal is in response to the number of projected passengers, the vehicle capacity value, the determined relative distance and the determined relative time and to maintain service of the stop locations.

2. The method of claim 1 wherein the action signal is configured to achieve a preferred relative distance and a preferred relative time between the plurality of vehicles along the route.

3. The method of claim 1 wherein the action signal is an audible action signal.

4. The method of claim 3 wherein the audible action signal includes at least one audible tone at a predetermined frequency.

5. The method of claim 1 wherein the route is comprised of stop segments and regular segments, wherein stop segments correspond to locations with transit stops.

6. The method of claim 1 further comprising:

determining when the at least one of the plurality of vehicles has not performed an action correlated to the action signal; and repeating the action signal when the at least one of the plurality of vehicles has not performed an action correlated to the action signal.

7. The method of claim 1 wherein the action signal comprises at least one of the actions of skip-stop or pass.

8. A non-transitory computer readable medium including instructions that when executed are operable to:

receive current locations of a plurality of mobile devices currently servicing a route, wherein the location information comprises locations of the plurality of vehicles determined by mobile devices coupled with the vehicles and the route comprises a plurality of stop locations serviced by individual vehicles of the plurality of vehicles according to a schedule;

receive traffic conditions for the route;

determine a number of projected passengers based on historical passenger information for at least one of the plurality of sequential stop locations;

identify a vehicle capacity value for at least one of the plurality of vehicles;

determine a relative distance between a first mobile device of the plurality of mobile devices and at least a second mobile device of the plurality of mobile devices as a function of the received current locations;

determine, with the controller, a relative time between the first and second vehicles based on the relative distance and traffic conditions; and generate an action signal for operation of at least one vehicle associated with one of the plurality of mobile devices to maintain the schedule based on the number of projected passengers, the vehicle capacity value, the determined relative distance, and the determined relative time.

9. The non-transitory computer readable medium of claim 8 further comprising:

determining when the at least one of the vehicles associated with the plurality of mobile devices has not performed an action correlated to the action signal; and repeating the action signal when the at least one of the vehicles associated with the plurality of mobile devices has not performed an action correlated to the action signal.

10. The non-transitory computer readable medium of claim 8, wherein the action signal is an audible action signal or a visible action signal.

11. The non-transitory computer readable medium of claim 8, wherein the action signal is comprised of audible language or audible tones.

12. The non-transitory computer readable medium of claim 8 wherein the action signal comprises at least one of the actions of skip-stop or pass.

13. An apparatus comprising:

a memory configured to store data representing a plurality of locations comprising a transit route, and data representing current locations of a plurality of vehicles currently traveling along the transit route, and data representing current traffic conditions, wherein individual vehicles of the plurality of vehicles are assigned different times for servicing stops of the transit route and the current locations of the plurality of vehicles determined by mobile devices located with the vehicles; and a controller configured to determine a relative time and a relative distance between a first vehicle of the plurality of vehicles and a second vehicle of the plurality of vehicles using the data representing the current locations of the plurality of vehicles and the data representing current traffic conditions, determine a number of projected passengers based on historical passenger information for at least one of the plurality of sequential stop locations, identify a vehicle capacity value for at least one of the plurality of vehicles; and generate an action signal for operation of at least one of the plurality of vehicles to maintain service of the transit route based on the number of projected passengers, the vehicle capacity value, the determined relative distance, and the determined relative time.

14. The apparatus of claim 13, wherein the action signal is comprised of a visible signal.

15. The apparatus of claim 13, wherein the action signal is an audible signal.

16. The apparatus of claim 13, wherein the controller is further configured to determine the location of a third vehicle of the plurality of vehicles, and the action signal is further based on the third vehicle location.

17. The apparatus of claim 13 wherein the action signal comprises at least one of the actions of skip-stop or pass.

18. An apparatus comprising:

a communications interface configured to receive data indicative of a calculated relative distance and a calculated relative time between a first vehicle of a plurality of vehicles servicing a route and at least a second vehicle of the plurality of vehicles traveling along the route, the route comprising a plurality of transit stops serviced independently by the first vehicle and the second vehicle at different times, the communications interface further configured to received projected passenger data for at least one of the plurality of transit stops;

position circuitry configured to determine the current location of the apparatus;

a controller configured to generate an action signal for operation of the first vehicle or the second vehicle to maintain service of the route based on the calculated relative distance, the calculated relative time, the projected passenger data, and the current location; and an output interface configured to present the action signal for the operation of the first vehicle or the second vehicle, wherein the apparatus is coupled with the first or the second vehicle and the current location is the current location of the first or the second vehicle determined using the position circuitry.

19. The apparatus of claim 18 wherein the action signal comprises at least one of the actions of skip-stop or pass.

* * * * *